US005146279A

United States Patent [19]

Seyfried

[11] Patent Number: 5,146,279

[45] Date of Patent: Sep. 8, 1992

[54] ACTIVE AIRFLOW SYSTEM FOR DEVELOPMENT APPARATUS

[75] Inventor: Joseph A. Seyfried, Webster, N.Y.

[73] Assignee: Xerox Corporation, Stamford, Conn.

[21] Appl. No.: 758,993

[22] Filed: Sep. 10, 1991

[51] Int. Cl.[5] ..... G03G 21/00

[52] U.S. Cl. ..... 355/215; 355/245; 355/326

[58] Field of Search ..... 355/215, 245, 30, 304, 355/326, 327; 118/653, 652, 645

[56] References Cited

U.S. PATENT DOCUMENTS

| | | | |
|---|---|---|---|
| 3,685,485 | 8/1972 | Kutsuwada | 118/654 |
| 3,703,957 | 11/1972 | Swanson et. al. | 209/144 |
| 4,029,047 | 6/1977 | Bell | 118/652 |
| 4,100,611 | 7/1978 | Jugle | 366/139 |
| 4,377,344 | 3/1983 | Nishikawa | 355/251 |
| 4,466,730 | 8/1984 | Jugle | 355/215 |
| 4,583,112 | 4/1986 | Morano et. al. | 355/215 |
| 4,666,282 | 5/1987 | Rowe | 355/215 |
| 4,928,144 | 5/1990 | Kasahara | 355/245 |

FOREIGN PATENT DOCUMENTS

| | | | |
|---|---|---|---|
| 0239267 | 10/1086 | Japan . | |
| 0120372 | 6/1985 | Japan | 355/245 |
| 0120376 | 6/1985 | Japan . | |
| 0124584 | 5/1990 | Japan | 355/245 |
| 1052019 | 12/1916 | United Kingdom . | |

*Primary Examiner*—A. T. Grimley
*Assistant Examiner*—Robert Beatty
*Attorney, Agent, or Firm*—Denis A. Robitaille

[57] ABSTRACT

A development apparatus having an active airflow system for generating negative air pressure to create an airflow out of a developer housing, drawing airborne contaminants from the developer housing. A developer system includes a plurality of developer housings being selectively moved into operative and inoperative poitions for development of a latent image on a photoconductive surface. As each developer housing is moved into and out of its operative position, an air duct is rotated in response to this movement for interfacing with, or sealing off, airflow through the housing, as appropriate. An apparatus of this type is used in a multicolor electrostatographic printing machine where succesive latent images are developed with different color developer material, thus preventing respective color developer materials from intermingling during the development process.

24 Claims, 4 Drawing Sheets

ACTIVE AIRFLOW SYSTEM FOR DEVELOPMENT APPARATUS

The present invention relates generally to an electrostatographic printing machine, and more particularly concerns an improved development apparatus having an active airflow system which minimizes the escape of airborne particles therefrom.

Generally, the process of electrostatographic copying is executed by exposing an optical image of an original document to a substantially uniformly charged photoreceptive member. Exposing an optical image to the charged photoreceptive member discharges the photoconductive surface thereof in areas corresponding to non-image segments in the original document, while maintaining charge on the photoreceptive member in image segments, thereby creating an electrostatic latent image reproduction of the original document on the photoreceptive member. This electrostatic latent image is subsequently developed into a visible image by a process in which a charged developing material is deposited onto the photoconductive surface of the photoreceptor so that the developing material is attracted to the charged image areas thereon. The developing material is then transferred from the photoreceptive member to a recording substrate on which the image may be permanently affixed in order to provide an output reproduction of the original document. The final step in this process involves cleaning the photoconductive surface of the photoreceptive member to remove any residual developing materials therefrom in preparation for successive imaging cycles.

Multi-color electrophotographic printing is substantially identical to the foregoing process described for black and white copying. However, rather than forming a single electrostatic latent image on the photoconductive surface, a plurality of latent images corresponding to different colors are recorded thereon. Each electrostatic latent image is developed with toner of a single color complimentary thereto and the development process is repeated a plurality of cycles to develop differently colored images with their respective complimentarily colored toner. Thereafter, each single color toner image is transferred to the copy substrate in superimposed registration with the prior toner image to create a multi-layered toner image on the copy substrate and the multi-layered toner image is permanently affixed to the copy substrate creating a color output copy.

Various types of development systems are known and have been employed in the electrostatographic arts. These systems utilize two component developer mixes or single component developer materials as well as powder or liquid developer materials. A typical two component developer mix generally comprises a dyed or colored thermoplastic powder, so-called toner particles, combined with coarser ferromagnetic granules, so called carrier beads. The toner particles and carrier beads are selected so that the toner particles acquire an appropriate electrostatic charge relative to the electrostatic latent image recorded on the photoconductive surface to be attracted thereto. When the developer mix is brought into contact with the charged photoconductive surface the greater attractive force of the electrostatic latent image recorded thereon causes the toner particles to transfer from the carrier beads and adhere to the electrostatic latent image.

In prior art electrophotographic printing machines, development systems have employed rotary impellers, fur brushes, bucket conveyors and magnetic brush systems to achieve the requisite uniformity in toner deposition. Magnetic brush systems achieve a high degree of uniform deposition and, therefore, numerous electrophotographic printing machines utilize this type of development system. Usually, a magnetic brush system includes a developer roll having a directional magnetic flux field to bring the magnetizable developer mix into contact with the charged photoconductive surface.

Generally, the developer roll of a magnetic brush development system is rotatably mounted in a fixed housing relative to the photoconductive surface. Developer rolls which are fixedly mounted relative to the photoconductive surface are positioned closely adjacent thereto so that the developer roller having the developer mix adhering thereto deposits toner particles on the photoconductive surface. Since multicolor development systems utilize a plurality of developer rollers, each being adapted to furnish the appropriately colored toner to the photoconductive surface, fixed deveolper housing systems restrict the quality of multicolor output copies. That is, when a developer material having toner of one color contacts the toner image of another color, intermingling of colors and physical damage to the toner powder image results. Thus, the toner image may become incorrectly colored and the multicolor copy produced thereby may lack the appropriate color balance, i.e. the color in the output copy does not correspond to the color in the original document.

To overcome the problems associated with fixedly mounted developer housings, developer housings have been retractably mounted in multicolor printing machines. In such systems, one developer housing will be positioned in the operative location adjacent the photoconductive surface while the remaining developer housings are positioned in a nonoperative mode spaced away from the photoconductive surface. In this manner, an individual developer housing is successively positioned adjacent the photoconductive surface to develop the electrostatic latent image with a given color toner while the other developer housings remain spaced therefrom in the non-operative position. An example of an electrophotographic printing machine utilizing the foregoing type of development system can be found in Model No. 6500 made by the Xerox Corporation.

An additional problem, associated most directly with the triboelectrification process, is the inadvertent escape of developing material, and, in particular, liquid or dry toner particles from the developer housing. Airborne toner particles carrying an electrostatic charge are readily attracted to various surfaces within the electrostatographic apparatus outside of the developer housing which can result in the contamination of various processing stations and machine components. Moreover, since the charge on the toner particles is not controlled, escaping toner particles can be developed on the photoreceptor, producing a background image on the reproduction of the original document. Contamination caused by the escape of developing material adversely effects machine reliability and performance as well as copy quality. For example, developing material escaping into the body of the machine can collect on a lens, an illuminating lamp, or a mirror, causing the exposure of the original document to be decreased dramatically. Furthermore, development of escaping toner particles is a serious contributor to the formation of background imaging. These problems are just a few of the difficulties associated with the escape of developing material in electrostatographic printing machines yielding non-uniform exposure, increased background, and generally unacceptable copy quality as well as unscheduled maintenance and repair by skilled field service technicians.

With the advent of multi-color electrophotographic printing, an additional problem is posed in that a plurality of discretely colored toners are utilized therein, each of which are arranged to produce a color complementary in color to that of the original document. Thus, if intermingling of the toner particles occurs, severe contamination of the development system will be the result. It is therefore evident that it is necessary to prevent the escape of toner particles and other airborne particles from each developer housing in order to prevent the intermingling of toner particles as well as to prevent the introduction of external dirt particles into the development system.

The issues involving developing material escape and the resultant problems associated therewith are well-recognized in the art of electrostatographic printing. Generally, therefore, a typical developer housing will include a seal or other physical barrier for preventing the migration of developing material outside of the developer housing. However, the peculiar characteristics of developing material and a general requirement for safeguarding the photoconductive surface of the photoreceptive member precludes the use of many configurations or existing materials which might otherwise provide an effective barrier for preventing the escape of developer material or other airborne contaminants from the developer housing.

Various solutions for addressing the problem of developing material escape and contamination have been suggested and utilized in which the developer housing is maintained at negative pressure relative to the ambient environment of the electrophotographic machine to generate an airflow that is directed out of the developer housing. Typically, such systems for providing negative pressure also include an air ducting apparatus for directing the induced airflow into a filter or other safe area. Such systems have been successful in preventing the escape of airborne particles from a developer housing to eliminate the problem of developing material contamination in electrophotographic machines.

Various techniques have been devised for preventing the escape of toner particles from the development system. The following disclosures appear to be relevant:

U.S. Pat. No. 3,685,485
Patentee: Kutsuwada et al.
Issued: August 22, 1972
U.S. Pat. No. 3,703,957
Patentee: Swanson et al.
Issued: November 28, 1972
U.S. Pat. No. 4,029,047
Patentee: Bell
Issued: October 28, 1985
U.S. Pat. No. 4,100,611
Patentee: Jugle
Issued: July 111, 1978
UK 1,052,019
Patentee: Lawes -continued Issued: December 21, 1966

The pertinent portions of the foregoing disclosures may be briefly summarized as follows:

U.S. Pat. No. 3,685,485 discloses a development station wherein a developer roll transports particles to a latent image recorded on a photoconductive member. A fan maintains a negative pressure within the development station so as to prevent particles from escaping therefrom. A filter catches any scattered particles to prevent them from escaping the development system.

U.S. Pat. No. 3,703,957 discloses a copying machine having a particle conveying system including a plurality of pneumatic ducts and a blower. A vacuum-type pickup device is attached to the blower and positioned to remove loose particles from the copy sheets exiting the machine. The pneumatic system includes a centrifugal separator to receive the particles from the vacuum pickup. The centrifugal separator separates the particles from the air and collects the particles in the chamber for subsequent re-use. The air exiting the separator passes through a filter prior to returning to the atmosphere.

U.S. Pat. No. 4,029,047 describes a system for reclaiming residual toner particles removed from a photoreceptor. A blower removes air and toner from a photoreceptor cleaner. The toner is separated from the moving air and stored for re-use with the clean air being vented to the atmosphere.

U.S. Pat. No. 4,100,611 describes a development system having filter disposed in a wall thereof and a vacuum system associated therewith for maintaining the chamber of a development system at a negative pressure to prevent the escape of particles therefrom. The developer material flows over the filter which cleans particles therefrom.

British Patent No. 1,052,019 discloses a photoreceptor cleaning system having brush rollers for removing the residue of powder images from the photoreceptor. The dust laden air is driven by a fan through a filter or an electrostatic precipitator from which the dust may be recovered.

In accordance with one aspect of the present invention, there is provided an apparatus for developing a latent image recorded on a member. Means are provided for developing the latent image with toner, wherein the deveoping means is movable between a nonoperative position spaced from the member to an operative position adjacent the member. The development apparatus is further provided with means for generating air pressure less than atmospheric pressure to create airflow out of the chamber to effect transport of airborne particles therefrom.

Pursuant to another aspect of the invention, an electrostatographic printing machine of the type in which latent images are developed for creating an output document is provided, wherein the printing machine includes development apparatus having a plurality of developer housings. The development apparatus includes means associated with each developer housing for selectively moving the housing between an operative position adjacent a latent image and a nonoperative position spaced from the latent image. Means for generating negative pressure to create airflow away from each developer housing in its operative position and to prevent airflow in each housing in its nonoperative position are also provided.

These and other aspects of the present invention will become apparent from the following description in conjunction with the accompanying drawings in which.

Figure 1:
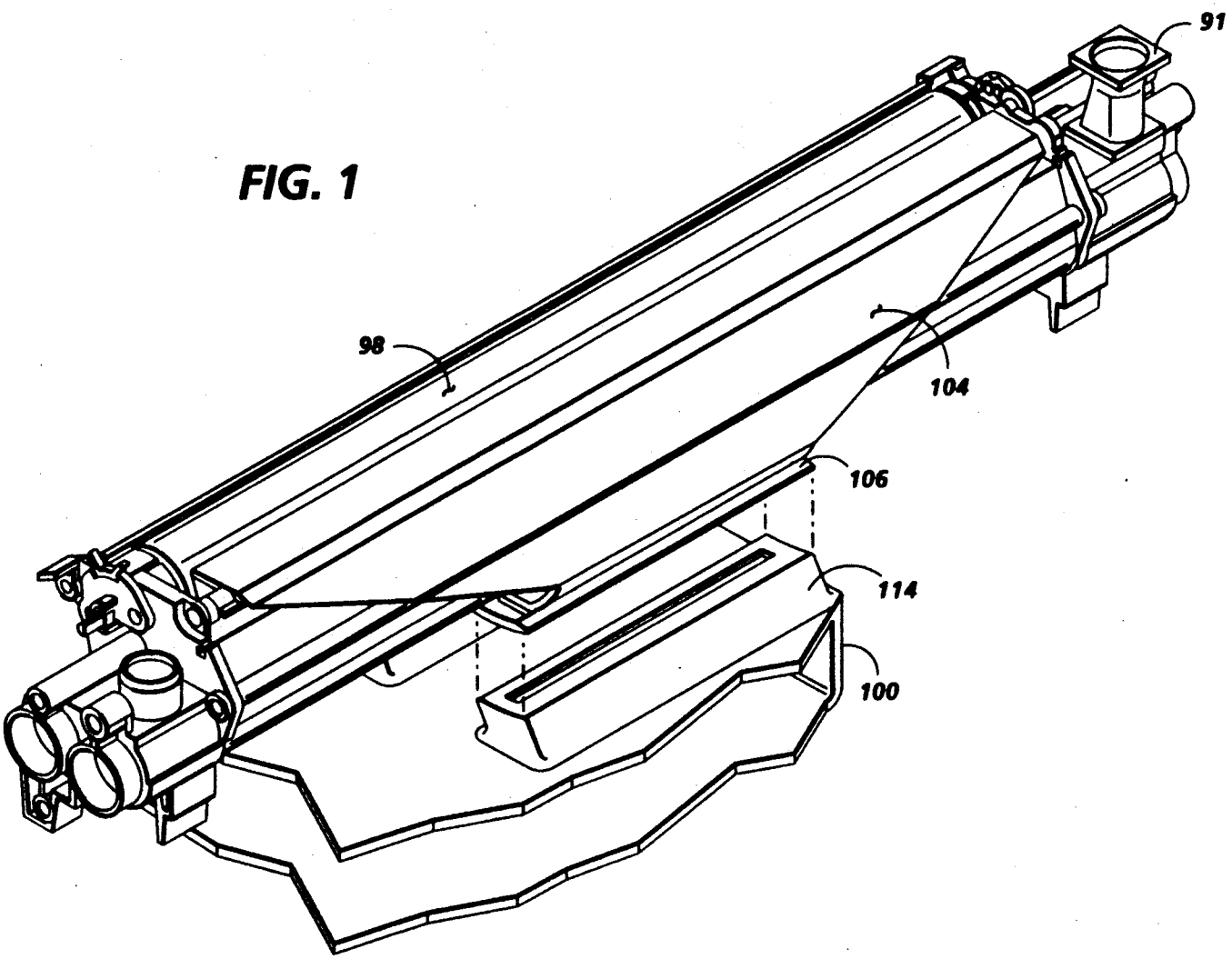
FIG. 1 is a perspective view of a developer housing showing the active airflow development apparatus and system of the present invention.

For a general understanding of the features of the present invention, reference is made to the drawings wherein like reference numerals have been used throughout to designate identical elements. While the present invention will be described in connection with a preferred embodiment thereof, it will understood that it is not intended that the invention be limited to this preferred embodiment. On the contrary, the present invention is intended to cover all alternatives, modifications, and equivalents as may be included within the spirit and scope of the invention as defined by the appended claims.

Figure 4:
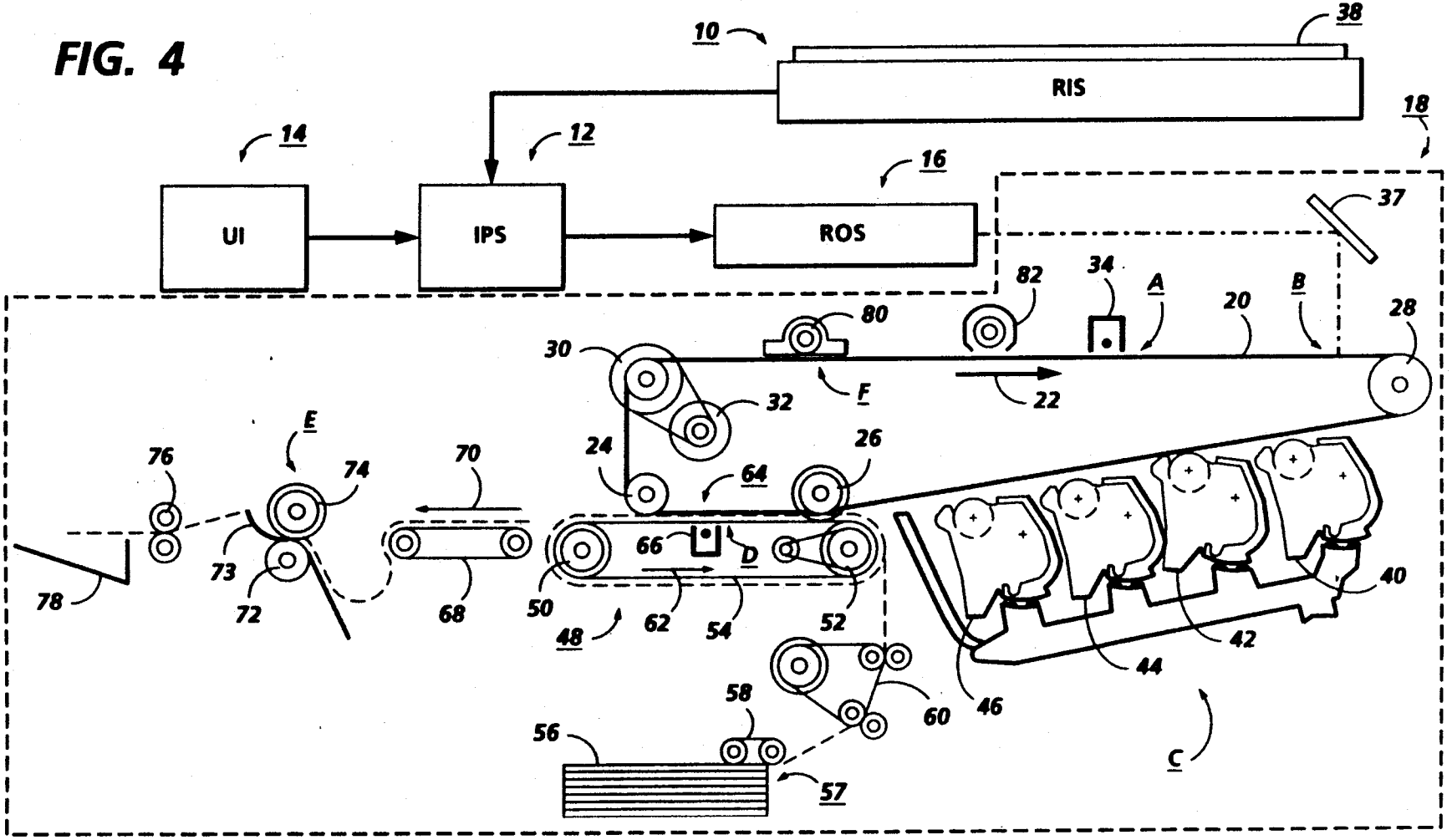
FIG. 4 is a schematic elevational view showing a multi-color electrophotographic printing machine incorporating the features of the present invention.

Referring initially to FIG. 4 before describing the specific features of the present invention, a schematic depiction of the various components of an exemplary multi-color electrophotographic reproducing machine incorporating the development apparatus of the present invention is provided. Although the apparatus of the present invention is particularly well adapted for use in an automatic multi-color electrophotographic reproducing machine, it will become apparent from the following discussion that the present development apparatus is equally well-suited for use in a wide variety of electrostatographic processing machines as well as various other systems requiring the prevention of particle escape therefrom and the elimination of airborne contamination therein. Thus, it will be appreciated that the invention described in detail herein is not necessarily limited in its application to the particular embodiment or embodiments shown herein.

Inasmuch as the art of electrophotographic printing is well known, the various processing stations employed in FIG. 4 will be shown schematically and their operation described briefly with reference thereto. The exemplary electrophotographic reproducing apparatus illustrated in FIG. 4 shows a multi-color electrostatographic printing machine wherein a multi-color original document 38 is positioned on a raster input scanner (RIS), indicated generally be reference numeral 10. The RIS 10 contains document illumination lamps, optics, a mechanical scanning drive, and at least one charge coupled device, or CCD array, coupled together to provide a system for capturing the entire multi-color image of the original document 38 and for converting the image to a series of raster scan lines having a set of primary color density information, i.e. red, green and blue densities, for each point in the original document.

The information developed by RIS 10 is transmitted to an image processing system (IPS), indicated generally by the reference numeral 12. IPS 12 converts the set of density information to a set of colorimetric coordinate signals and manages the image data flow to a raster output scanner (ROS), indicated generally by the reference numeral 16. A user interface (UI), indicated generally by the reference numeral 14, is coupled to IPS 12 for communication therewith, enabling an operator to control various operator adjustable functions. UI 14 may be a touch screen, or any other suitable control panel which provides a machine operator with the capability to adjust selective parameters of the copy or print.

ROS 16 includes a laser with rotating polygon mirror blocks. Preferably, a nine facet polygon is used to produce a flowing light image of the original document in a non-distorted manner. The ROS 16 illuminates, via mirror 37, the charged portion of a photoconductive belt 20 of a printer or marking engine, indicated generally by the reference numeral 18, at a rate of about 400 pixels per inch.

The photoconductive belt 20 is preferably fabricated from a photoconductive material coated on a grounding layer, which, in turn, is coated on an anti-curl backing layer. The photoconductive material is made from a transport layer coated on a generator layer. The transport layer transports positive charges from the generator layer which is coated on a very thin grounding layer which allows light to pass therethrough. The transport layer contains molecules of di-m-tolydiphenylbiphenyldiamine dispersed in a polycarbonate while the generation layer is made from trigonal selenium and the grounding layer is made from a titanium coated Mylar. The grounding layer is very thin and allows light to pass therethrough. It will be appreciated by one of skill in the art that various other suitable photoconductive materials, grounding layers, and anti-curl backing layers may also be employed.

With continued reference to FIG. 4, the printer or marking engine 18 of the present multi-color electronic reprographic printing system is an electrophotographic printing machine. In the exemplary marking engine, photoconductive belt 20, moves in the direction of arrow 22 to advance the photoconductive surface thereof through various successive processing stations disposed about the path of movement thereof. Photoconductive belt 20 is entrained about rotatably mounted transfer rollers 24 and 26, tension roller 28, and drive roller 30. Drive roller 30 is rotated by a motor 32 coupled thereto by any suitable means such as a belt drive, so as to advance belt 20.

Initially, a portion of photoconductive belt 20 passes through a charging station, indicated generally by the reference letter A. At charging station A, a corona generating device 34 charges photoconductive belt 20 to a relatively high, substantially uniform potential. A plurality of corona generating devices may also be used for this operation.

Once charged, the photoconductive belt 20 is advanced to an exposure station, indicated generally by reference letter B, where a modulated light beam corresponding to information derived by RIS 10 is transmitted onto the photoconductive surface. The modulated light beam illuminates selective portions of the photoconductive surface to form an electrostatic latent image of the original multi-color document on the photoconductive surface of belt 20. The photoconductive belt 20 is exposed at least three times to record at least three latent images thereon corresponding to the complementary primary colors in the original multi-color document.

After the electrostatic latent images have been recorded on photoconductive belt 20, the belt 20 advances to a development station, indicated generally by C. Development station C comprises a magnetic brush development system including four individual developer units indicated by reference numerals 40, 42, 44 and 46. In the exemplary electrostatographic machine shown in FIG. 4, the developer units are of a type generally referred to in the art as "magnetic brush development units" used for depositing dry developing material onto the electrostatic latent image. It will be understood however that the present invention may operate with toner comprising dry powder or liquid material.

A typical magnetic brush development system employs a magnetizable developer material including magnetic carrier granules having toner particles adhering triboelectrically thereto. The developer material is continually brought through a directional flux field to form a brush of developer material. In each developer unit, developer material is constantly mixed so as to continually provide a magnetic roll brush with fresh developer material such that the magnetic roll brush having developer material thereon is brought into contact with the photoconductive surface of photoconductive belt 20. In order to achieve multi-color development, developer units 40, 42, and 44, respectively, apply toner particles of a specific color corresponding to the compliment of the specific color separated electrostatic latent image recorded on the photoconductive surface. The color of the toner particles in each developer unit is adapted to absorb light within a predetermined spectral region of the electromagnetic wave spectrum. For example, an electrostatic latent image formed by discharging the portions of charge on the photoconductive belt 20 corresponding to the green regions of the original document 38 will record the red and blue portions as areas of relatively high charge density on photoconductive belt 20, while the green areas will be reduced to a voltage level ineffective for development. A visible image is then developed on the charged areas by having developer unit 40 apply green absorbing (magenta) toner particles onto the electrostatic latent image recorded on photoconductive belt 20. Similarly, a blue separation is developed by developer unit 42 with blue absorbing (yellow) toner particles, and the red separation is developed by developer unit 44 with red absorbing (cyan) toner particles. Developer unit 46 contains black toner particles and may be used to develop the black electrostatic latent image areas formed from a color or black and white original document.

Each of the developer units is moved into and out of an operative position to develop the latent image on belt 20. In the operative position, the magnetic brush is positioned substantially adjacent the photoconductive belt, while in the non-operative position, the magnetic brush is spaced therefrom. In FIG. 4, developer unit 42 is shown in the operative position with developer units 40, 44 and 46 being in the non-operative position. During development of each electrostatic latent image, only one developer unit is in the operative position, while the remaining developer units are maintained in the non-operative position. This insures that each electrostatic latent image is developed with toner particles of the appropriate color without the commingling of developer materials of different colors. The detailed structure of the development system C will be described hereinafter with reference to FIGS. 1-3.

After development, the toner image on photoconductive belt 20 is moved to a transfer station, indicated generally by the reference letter D. The transfer station D includes a transfer zone, generally indicated by reference numeral 64, where the toner image is transferred from the photoconductive belt 20 to a recording substrate, such as plain paper or other various sheet support materials. The transfer station D further includes a transport apparatus, indicated generally by the reference numeral 48, for transporting the recording substrate into contact with photoconductive belt 20.

Transport apparatus 48 includes a pair of spaced belts 54 entrained about a pair of substantially cylindrical rollers 50 and 52. A gripping apparatus (not shown) extends between belts 54 and moves in unison therewith to advance a sheet of recording substrate 56 delivered to the gripping apparatus from a stack of sheets disposed on a tray 57. A friction feed roll 58 advances the uppermost sheet from the stack in tray 57 onto a pre-transfer transport 60, which, in turn, advances the sheet of recording substrate 56 to sheet transport 48 in synchronism with the movement of the gripping apparatus. In this way, the recording substrate 56 arrives at a preselected position, namely a loading zone, to be received by the open gripping apparatus which secures the sheet of recording substrate thereto for transport through a recirculating path. The sheet 56 is thereby placed into contact with the photoconductive belt 20, as belts 54 move in the direction of arrow 62 in synchronism with the developed toner image on the photoconductive belt 20. Thus, the gripping apparatus described hereinabove enables each of the appropriately developed electrostatic latent images recorded on the photoconductive surface to be transferred to the recording substrate in superimposed registration with one another, forming a multi-color copy of the colored original document.

At transfer zone 64, a corona generating device 66 sprays ions onto the backside of the recording substrate to induce a charge thereon at a proper magnitude and polarity for attracting the toner image from photoconductive belt 20. The recording substrate remains secured to the gripping apparatus moving in a recirculating path for three cycles such that each different color toner image is transferred to the recording substrate in superimposed registration with one another. One skilled in the art will appreciate that the sheet may move in a recirculating path for four or more cycles if desirable such as when under color black removal is used.

After the last transfer operation, the sheet transport system 48 directs the recording substrate to a vacuum conveyor 68 for transporting the recording substrate in the direction of arrow 70 to a fusing station, indicated generally by the reference letter E. The fusing station includes a heated fuser roll 74 and a backup pressure roll 72 forming a fuser nip therebetween. The sheet of recording substrate 56 passes through the fuser nip 71 so that the toner image on the recording substrate 56 contacts fuser roll 74 to be affixed to the recording substrate 56. Thereafter, the recording substrate 56 is advanced through a baffle assembly 73 to a pair of rolls 76 for transporting the final output document to a catch tray 78 to be removed by a machine operator.

The last processing station in the direction of movement of belt 20 is a cleaning station, indicated generally by the reference letter F. A rotatably mounted fibrous brush 80 is positioned in the cleaning station A and maintained in contact with photoconductive belt 20 to remove residual toner particles remaining after the transfer operation. Thereafter, lamp 82 illuminates photoconductive belt 20 to remove any residual charge remaining thereon prior to the start of the next successive print or copy cycle.

In summary, the ROS 16 exposes the photoconductive belt 20 to record a set of subtractive primary latent images thereon, corresponding to the signals transmitted from IPS 12. One latent image is developed with cyan developer material, another is developed with magenta developer material, and the third latent image is developed with yellow developer material. These developed images are transferred to a recording substrate such as paper or vellum in superimposed registration with one another to form a multi-colored image thereon. This multi-colored image is then fused to the recording substrate to form a color output document. The foregoing description should be sufficient for the purposes of the present application for patent to illustrate the general application of a multi-color electrophotographic printing apparatus incorporating the features of the present invention. As described, an electrophotographic printing apparatus may take the form of any of several well known devices or systems. Variations of specific electrostatographic processing subsystems or processes may be expected without effecting the operation of the present invention.

Figure 2:
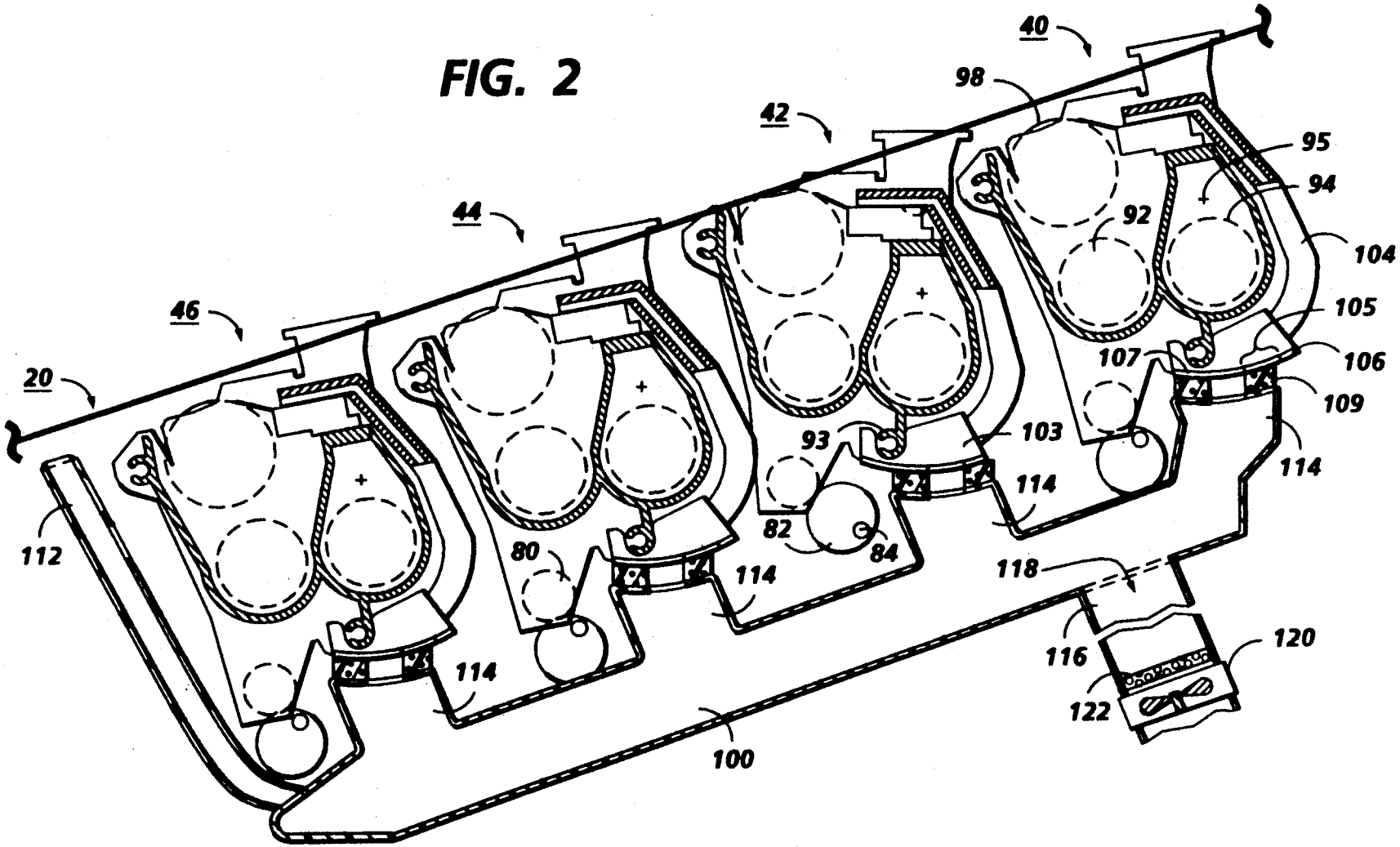
FIG. 2 is a side view of the developer system of the present invention.

Moving now to FIGS. 1-3, the particular features of the multi-color development system of the present invention will be described in greater detail. Development units 40, 42, 44, 46 are depicted in FIG. 2 in a side view to more clearly indicate the various components included therein. An individual developer unit 40 is shown in a perspective view in FIG. 1 to illustrate the relationship of the various components of each developer housing. The primary distinction between each developer unit is the color of the toner particles contained therein. Developer unit 40 may have magenta toner particles, unit 42 may have yellow toner particles, unit 44 may have cyan toner particles and developer unit 46 may contain black toner particles, although different color combinations may be utilized. Minor geometric differences may exist in each developer unit due to mounting configurations without effecting the detailed description of the individual development unit which follows. In the interest of clarity, and since each developer unit 40, 42, 44 and 46 is substantially identical, only the features and components of a single developer unit will described in detail.

An individual developer unit, as for example, developer unit 40, includes a housing 96 defining a chamber having a developer roll 98 mounted, at least partially, therein. Developer roll 98 is mounted rotatably in the chamber of housing 96 via shaft 97 which supports the developer roll 96 on suitable bearings located in the end walls of developer housing 96. Mixing augers 92 and 94 are also mounted within the chamber of housing 96. Mixing augers 92 and 94 rotate in opposite directions for intermixing the toner particles and carrier beads of developing material stored therein to induce opposite charges thereon, causing the toner particles and carrier beads to be attracted to one another via a process known as triboelectrification, as previously described herein. Additional toner particles are stored in a toner dispenser (not shown) and supplied to the developer housing 96 via a toner inlet port 91.

Preferably, developer roll 98 includes a stationary cylindrical magnet disposed within a rotating sleeve having an irregular or roughened exterior surface. The magnetic field produced by the fixed magnetic core of the developer roll 98 attracts the developer material from the mixing augers 92 and 94 to the rotating sleeve of the developer roll 98 which transports the developing material into contact with the electrostatic latent image recorded on the photoconductive surface 20. In this manner, the toner particles are attracted to the electrostatic latent image, forming a toner powder image thereof on the photoconductive belt 20. Preferably, the developer roll 98 is rotated in the direction of arrow 99, counter to the direction of travel of photoconductive belt 20 to develop the latent image thereon.

Each individual developer housing 96 is mounted to a support frame (not shown) via a pivot pin 95 about which the developer housing 96 rotates. Developer housing 96 is supported on cam 82 via pinion wheel 80 mounted on housing 96, exterior to the chamber defined thereby. Shaft 84 is coupled to a motor (not shown), by any suitable means, for rotating the cam 82 in response thereto. Thus, energization of the motor rotates the cam 82, exerts a force against the pinion wheel 80 to raise or lower the developer unit as appropriate to move the developer unit into or out of an operative position adjacent the photoconductive belt 20.

Figure 3:
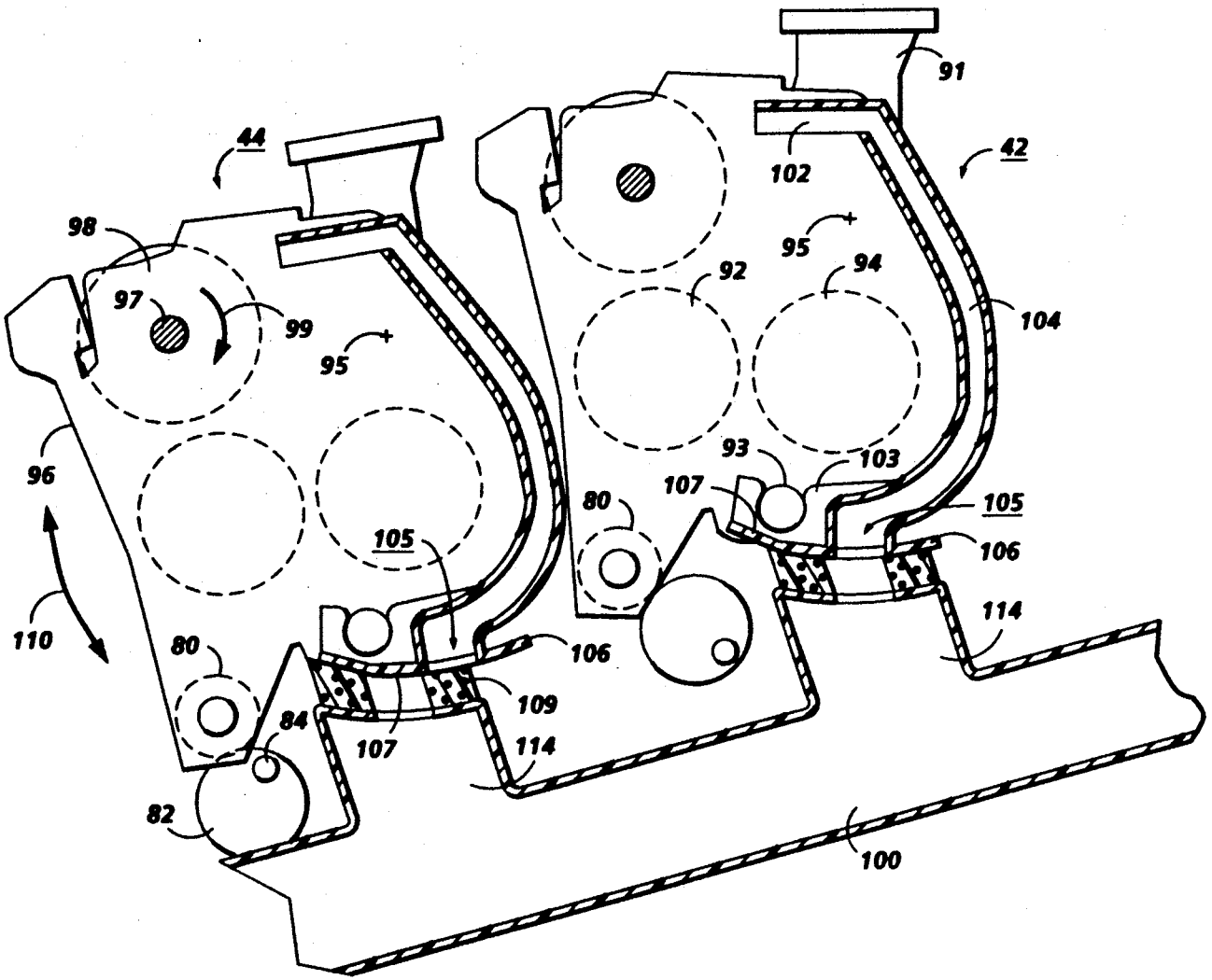
FIG. 3 is a side view showing two developer housings of the developer system of the present invention with one housing in the operative position and one housing in the inoperative position.

In operation, as cam 82 is rotated by the energization of the motor coupled to shaft 84, the developer housing 96 rotates about pivot pin 95 into an operative position adjacent photoconductive surface 20, as can be seen by the developer housing on the right side of FIG. 3. Conversely, as cam 82 is further rotated or rotated in an opposite direction, the developer housing 96 is rotated about pivot pin 95 into an inoperative position away from the photoconductive surface, as can be seen by the developer housing on the left side of FIG. 3. Each developer housing 96 rotates approximately 7 degrees, shifting the developer roll surface approximately 7 mm as the housing translates from the operative position to the non-operative position. In this manner, the developer material of developer unit 40 is spaced from the photoconductive belt 20 before the next developer unit 42, for example, is positioned in the operative position to effect development of the next successive latent image with a different color toner, thereby preventing the intermingling of the different color developer materials of each developer housing.

The development system of the present invention further includes an active system for generating air pressure less than atmospheric pressure, so called, negative pressure, to create air flow through the airflow system. The active airflow system comprises an air plenum 100 and individual air ducts 104 associated with each developer unit 40, 42, 44 and 46. Air plenum 100 includes a stationary air inlet port 112, a plurality of apertured air channels 114, and an exhaust port 116. Air inlet port 112 creates a stationary air duct for providing a continuous supply of air through the plenum 100. Exhaust port 116 couples the air plenum 100 to an exhaust fan 120 driven by a suitable motor (not shown) for generating the negative pressure and thus, the airflow through the plenum 100 in the direction of arrow 118.

Exhaust port 116 may be further coupled to a detachable filter element 122 of any suitable means for separating and capturing airborne contaminants from the airflow therethrough. Filter element 122 may preferably be an electrostatic filter layer comprising laminated layers of thin fibers such as polyvinyl chloride, polyester, polyacrylonitrite, polyethylene, polypropylene or the like. A suitable filtering system of this type is described in U.S. Pat. No. 4,100,611 issued to Jugle in 1978, the relevant portions thereof being hereby incorporated by reference into the present application.

One skilled in the art will appreciate that, depending upon the surface characteristics of the developer roll and the type of toner used (dry or liquid), sufficient air flow may be generated to cause the flow of airborne particles through the air ducting system without the use of an exhaust fan since negative pressure may be generated within the development system via alternative means. For example, air flow is generated by the movement of belt 20 in the direction of arrow 22, creating a flow of air into each developer housing chamber and through each air duct 104. Thus, negative pressure is generated within each developer housing chamber, causing air to flow through each air duct 104 to the air plenum 100. The rotation of the developer roll 98 further induces air flow into the air duct 104. The combined air flow causes any airborne toner particles as well as any other airborne contaminants to flow through the aperture at the interface between air duct 104 and air plenum 100 to remove contaminants from the developing region. In this way, toner particle accumulation and the contamination caused thereby is prevented. The active airflow system of the present invention further ensures that toner particles will not escape from a developer housing so as to intermingle with toner particles from the other developer housings.

Each air duct 104 is mounted to a respective associated developer unit 40, 42, 44 or 46 via a mounting bracket 103 connected to a support bar 93 on the exterior of housing 96 so as to move in conjunction therewith. The air duct 104 includes an air inlet port 102, adjacent the developer roll 98, and further includes a valve member 106 for interfacing with an associated aperture of air channel 114 in air plenum 100. Valve member 106 includes an aperture 105 and a seal member 107 disposed adjacent one another. The interface between air duct 104 and air channel 114 is provided with a gasket member 109 therebetween for maintaining an air tight seal. Valve member 105 and air channel 114 are provided with cooperative concentric arcuate support surfaces therebetween. Thus, as each developer housing is rotated in and out of its operative position, as described hereinabove, valve member 105 translates rotatably with the pivoting motion of housing 96 to position either aperture 105 or seal member 107 adjacent to the aperture of air channel 114.

In operation, cam 82 causes housing 96 to rotate up or down in the direction of arrow 110. As cam 82 rotates, a force is exerted on pinion wheel 80 which, in turn, shifts developer housing 96 in and out of the operative position. When housing 96 is in the operative position, developer roller 98 is positioned adjacent to the photoreceptive belt 20 so as to transport the developer material closely adjacent to the photoconductive belt 20, thereby developing the electrostatic latent image thereon. As housing 96 moves into the operative position, valve member 106 is rotated so that aperture 105 is aligned with the aperture of air channel 114, creating an open interface between air duct 104 and air plenum 100. Conversely, after development of the electrostatic image is complete, cam 82 is rotated to cause housing 96 to move from the operative position to the non-operative position. Similarly, as housing 96 is moved into the non-operative position, seal member 107 is aligned with the aperture of air channel 114, closing the interface between air duct 104 and air plenum 100 to prevent airflow therethrough. This airflow switching system provides a mechanism for shutting off air ducts when not in use to provide airflow through a developer housing 96 only when that particular housing is in the operative position. Thus, air pressure requirements are minimized and significantly lower power is required to operate the active airflow system of the present invention.

When developer unit 40 is in the operative position, developer units 42, 44 and 46 are positioned in the inoperative mode. Alternatively, if one of the other developer units is positioned in the operative mode, developer unit 40 is in the inoperative mode. In this manner, successive electrostatic latent images are developed with different colored toner particles from each individual developer unit 40, 42, 44 or 46. As previously indicated and described with respect to FIG. 4 each toner powder image developed on photoconductive belt 20 is subsequently transferred to sheet material 56 in superimposed registration to form the resultant multi-color output document. During development, air plenum 100 directs a negative pressure air flow through each developer housing via air duct 104. The negative pressure has the effect of drawing airborne toner particles away from the photoconductive surface of belt 20 toward the air plenum 100 and through exhaust port 116. The magnitude of the negative pressure is selected so that airflow does not disturb the carrier granules on the developer roll 98 while providing sufficient air flow to draw airborne toner particles away from the photoconductive surface 20.

In recapitulation, it will be clear from the foregoing description of the invention, that a development apparatus is provided with an active airflow system for generting negative pressure to prevent the escape of toner and other airborne contaminants beyond the developer housing. The development apparatus of the present invention rotates an individual developer housing into an operative position for applying toner particles to a latent image on a photoconductive belt. As the developer housing is rotated into the operative position, an aperture in an air duct is aligned with an air channel for providing negative pressure to the developer housing creating an airflow to draw airborne contaminants therefrom. Conversely, when the developer housing is rotated into an inoperative position, a seal member is rotated into alignment with the air channel to prevent air flow through the developer housing. This active airflow system provides an efficient and effective device for preventing the intermingling of different color toner particles from each developer housing on the same electrostatic latent image.

It is, therefore, evident that there has been provided in accordance with the present invention, a development apparatus having an active airflow system that fully satisfies the aims and advantages hereinbefore set forth. While the invention has been described in conjunction with a specific embodiment thereof, it will be appreciated that many alternatives, modifications, and variations will be apparent to those of skill in the art. Accordingly, the present application for patent is intended to embrace all such alternatives, modifications, and variations as fall within the scope of the appended claims.

I claim:

1. An apparatus for developing a latent image recorded on a member, comprising:

means for developing a latent image with toner, said developing means being movable between a nonoperative position remote from the member and an operative position adjacent the member; and means, responsive to said movement of said developing means from said non-operative position, to said operative position, for generating air pressure less than atmospheric pressure in said developing means to effect transport of airborne particles therefrom.

2. The apparatus of claim 1 further including means for moving said developing means between said operative position and said nonoperative position.

3. The apparatus of claim 1, further including:

at least one housing defining a chamber for storing a supply of toner therein, said at least one housing being mounted for rotation about a pivot point; and means for translating said housing about said pivot point for moving said housing through an angle of rotation to selectively translate said housing between said nonoperative position remote from said electrostatic latent image and said operative position adjacent said electrostatic latent image;

4. The apparatus of claim 3, wherein said translating means includes:

a pinion wheel mounted exterior to said housing; and a cam disposed in abutment with said pinion wheel for exerting a force to thereon to translate said housing about said pivot point.

5. The apparatus of claim 1, wherein said air pressure generating means includes:

at least one air duct including an air inlet port for directing airflow away from said developing means; and an air plenum coupled to said air duct, including an exhaust port for providing an enclosed passageway through which the airflow travels.

6. The apparatus of claim 5, wherein said at least one air duct further includes a valve member disposed adjacent said air plenum for switchably permitting the airflow through said air duct when said housing is in the operative position and preventing the airflow through said air duct when said housing is in the nonoperative position.

7. The apparatus of claim 6, wherein said valve member includes an aperture and a seal member disposed adjacent one another for switchably providing an open passageway between said air plenum and said air duct with said housing in the operative position and providing a closed passageway between said air plenum and said air duct with said housing in the nonoperative position.

8. The apparatus of claim 5, wherein said air plenum further includes filter means coupled to said exhausts port for seperating airborne contaminants from the airflow.

9. The apparatus of claim 5, wherein said air plenum further includes an exhaust fan coupled to said exhaust port for inducing the airflow from said chamber.

10. The apparatus of claim 9, wherein said air plenum includes a stationary air inlet port for providing a constant supply of air to said exhaust fan.

11. The apparatus of claim 5, wherein said air plenum further includes at least one air channel for coupling said air plenum to said air duct, said air channel having an aperture for forming an air passageway between said air channel and said air duct.

12. The apparatus of claim 11, wherein said air pressure generating means further includes a gasket member disposed between said air plenum and said air duct, surrounding said aperture in said air channel, for providing an airtight seal between said air plenum and said air duct.

13. An electrostatographic printing machine wherein an electrostatic latent image is recoreded on a photoconductive member for development to create an output document, comprising:

means for developing the latent image with toner, said developing means being movable between a nonoperative position remote from the member and an operative position adjacent the member; and means, responsive to said movement of said developing means from said non-operative position, to said operative position, for generating air pressure less than atmospheric pressure in said developing means to effect transport of airborne particles therefrom.

14. The electrostatographic printing machine of claim 13, further including means for moving said developing means between said operative positon and said nonoperative position.

15. The electrostatographic printing machine of claim 13 wherein the developing means includes:

a plurality of developer housings each defining a chamber for storing a supply of toner therein, each of said plurality of developer housings being mounted for rotation about a respective pivot point; and means for translating each of said plurality of housings about said respective pivot point for moving said housing through an angle of rotation, said housing being selectively translated between said nonoperative position spaced away from said photoconductive member and said operative position adjacent said photoconductive member.

16. The electrostatographic printing machine of claim 15, wherein said translating means includes:

a pinion wheel mounted on the exterior of said housing; and a cam disposed in abutment with said pinion wheel for exerting a force thereon to translate said housing about said pivot point.

17. The electrostatographic printing machine of claim 13, wherein said air pressure generating means includes:

a plurality of air ducts, each mounted on a respective developer housing and including an air inlet port for directing airflow away from said housing; and an air plenum coupled to said plurality of air ducts, including an exhaust port for providing an enclosed passageway through which the airflow travels.

18. The electrostatographic printing machine of claim 17, wherein each of said plurality of air ducts further includes a valve member disposed adjacent said air plenum for switchably permitting the airflow between said air plenum and said air duct when said housing is in the operative position and preventing the airflow between said air plenum and said air duct when said housing is in the nonoperative position.

19. The electrostatographic printing machine of claim 18, wherein said valve member includes an aperture and a seal member disposed adjacent one another for switchably providing an open passageway between said air plenum and said air duct with said housing in the operative position and providing a closed passageway between said air plenum and said air duct with said housing in the nonoperative position.

20. The electrostatographic printing machine of claim 17, wherein said air plenum further includes filter means coupled to said exhaust port for seperating airborne contaminants from the airflow.

21. The electrostatographic printing machine of 17, wherein said air plenum further includes an exhaust fan coupled to said exhaust port including the airflow from said chamber.

22. The electrostatographic printing machine of 21, wherein said air plenum includes a stationary air inlet port for providing a constant supply of air to said exhaust fan.

23. The electrostatographic printing machine of claim 17, wherein said air plenum further includes a plurality of air channels for coupling said air plenum to each of said plurality of air ducts, each of said plurality of air channels having an aperture for forming an air passageway between said plurality of air channels and said plurality of air ducts.

24. The electrostatographic printing machine of claim 23, wherein said airflow providing means further includes a plurality of gasket members, each disposed between said air plenum and said air duct surrounding said aperture in each of said plurality of air channels for providing an airtight seal between said air plenum and each of said plurality of air ducts.

* * * * *